US008720407B2

(12) United States Patent
Pfau et al.

(10) Patent No.: US 8,720,407 B2
(45) Date of Patent: May 13, 2014

(54) INTERNAL COMBUSTION ENGINE

(75) Inventors: Joachim Pfau, Markdorf (DE); Jürgen Giesselmann, Markdorf (DE); Manfred Sulzmann, Meckenbeuren (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 328 days.

(21) Appl. No.: 13/317,589

(22) Filed: Oct. 21, 2011

(65) Prior Publication Data

US 2012/0118256 A1 May 17, 2012

Related U.S. Application Data

(63) Continuation-in-part of application No. PCT/EP2010/002153, filed on Apr. 6, 2010.

(30) Foreign Application Priority Data

Apr. 22, 2009 (DE) ..... 10 2009 018 475

(51) Int. Cl.
*F02F 7/00* (2006.01)

(52) U.S. Cl.
USPC ..... 123/195 R; 123/195 A

(58) Field of Classification Search
CPC ..... F02B 67/04; F02F 7/00; F02F 7/0012; F02F 7/0043; F02F 7/0046; F02F 7/0048; F02F 7/0051; F02F 7/0053; F02F 7/0058; F02F 2007/0043; F02F 2007/0053
USPC ..... 123/195 R, 195 A, 195 C, 198 C, 198 E
See application file for complete search history.

(56) References Cited

U.S. PATENT DOCUMENTS

| | | | | |
|---|---|---|---|---|
| 3,502,059 | A | 3/1970 | Dennis et al. | |
| 4,321,896 | A * | 3/1982 | Kasting | 123/195 A |
| 5,000,140 | A * | 3/1991 | Bates et al. | 123/192.2 |
| 6,415,758 | B1 * | 7/2002 | Pierro et al. | 123/195 R |
| 7,047,929 | B2 * | 5/2006 | Aketa et al. | 123/195 R |

FOREIGN PATENT DOCUMENTS

| | | |
|---|---|---|
| DE | 199 60 130 | 3/2001 |
| DE | 100 02 538 | 7/2001 |
| EP | 1 048 824 | 11/2000 |
| WO | WO 2005/003526 | 1/2005 |

* cited by examiner

*Primary Examiner* — Hung Q Nguyen
(74) *Attorney, Agent, or Firm* — Klaus J. Bach

(57) ABSTRACT

In an engine crankcase including a crankshaft supported at its front end by a crankshaft bearing having a crankshaft bearing cover including a bearing top part and a bearing bottom part and a front end gear drive arranged in front of the crankcase for driving auxiliary component and including a first drive gear mounted onto the crankshaft, a second gear mounted to the auxiliary component and an intermediate gear in meshing engagement with the first and second gears and supported on a support plate, the support plate is screwed onto the crankcase, the bearing top part and the bearing bottom part.

3 Claims, 1 Drawing Sheet

INTERNAL COMBUSTION ENGINE

This is a Continuation-In-Part application of pending international patent application PCT/EP2010/002153 filed Apr. 6, 2010 and claiming the priority of German Patent application 10 2009 018 475.9 filed Apr. 22, 2009.

BACKGROUND OF THE INVENTION

The invention resides in a crankcase with a crankshaft chamber in which a crankshaft is arranged, including a front end bearing cover with a bearing top part and a bearing bottom part for supporting the crankshaft and a front gear drive for driving an auxiliary unit comprising a first drive gear disposed on the crankshaft, a second drive gear disposed on the auxiliary unit and an intermediate gear in meshing engagement with the first and the second drive gears.

In an internal combustion engine, the drive for the auxiliary units such as the oil and water pumps is arranged at the end of the engine opposite the power output shaft end. The drive is in the form of front end spur gears including a first drive gear disposed on the camshaft, a second drive gear disposed on the auxiliary unit and an intermediate transmission gear. In the area of the support structure for the intermediate transmission gear there is the crankshaft chamber which does not offer a mounting possibility for a support structure the intermediate gear since the crankcase wall has an insufficient wall thickness. This problem is solved by supporting the intermediate transmission gear between a first and a second support plate which form a bearing unit. Such a solution is known from DE 199 60 130 A1. This support unit abuts the front side of the crank housing and is bolted to the upper bearing part (upper bearing bridge). However, because of the complex arrangement, the support unit is sensitive to vibrations so that a hydraulic play compensation element is required for damping the vibrations.

A more simple arrangement is disclosed in DE 100 02 538 A1. Herein, the intermediate transmission gear is arranged via a support pin on an elongated support plate. The support plate is mounted to the crankcase by way of two connecting areas so that, after assembly, the intermediate transmission gear is disposed between the housing wall and the support plate. The connecting areas are again disposed on the axis of symmetry of the intermediate transmission gear which extends normal to the axis of rotation. By an arrangement for applying a pretensioning force to the support plate, the drive gears and the intermediate gear are kept in proper engagement. However, because of the type of design this solution cannot be used in proximity of the crankcase chamber. Since the support plate is subjected to bending by the changing load of the drive gears and the intermediate transmission gear, the support plate must be of solid construction.

It is the object of the present invention to provide a simple gear drive arranged in front of a crankcase of an internal combustion engine for driving auxiliary components of the internal combustion engine.

SUMMARY OF THE INVENTION

In an engine crankcase including a crankshaft supported at its front end by a crankshaft bearing having a crankshaft bearing cover including a bearing top part and a bearing bottom part and a front end gear drive arranged in front of the crankcase for driving auxiliary component and including a first drive gear mounted onto the crankshaft, a second gear mounted to the auxiliary component and an intermediate gear in meshing engagement with the first and second gears and supported on a support plate, the support plate is screwed onto the crankcase, the bearing top part and the bearing bottom part.

With the additional bolt connecting points for the support plate, in particular at the bottom part of the bearing of the crankshaft the free bending length and consequently the bending moments effective on the support plate are small. The high stability achieved thereby on the other hand permits also the use of a thinner support plate with corresponding weight savings. Additional damping means such as hydraulic compensation elements are no longer necessary. Altogether the support plate is simple and inexpensive to manufacture.

The support plate and a support pin on which the intermediate transmission gear is rotatably supported are integrally formed. In connection with the crankcases having auxiliary components at the A- as well as the B-side that is at opposite sides of the crankshaft gear, a corresponding support plate is provided at each side.

A preferred embodiment of the invention will be described below with reference to the accompanying drawings.

DESCRIPTION OF A PARTICULAR EMBODIMENT

Figure 1:
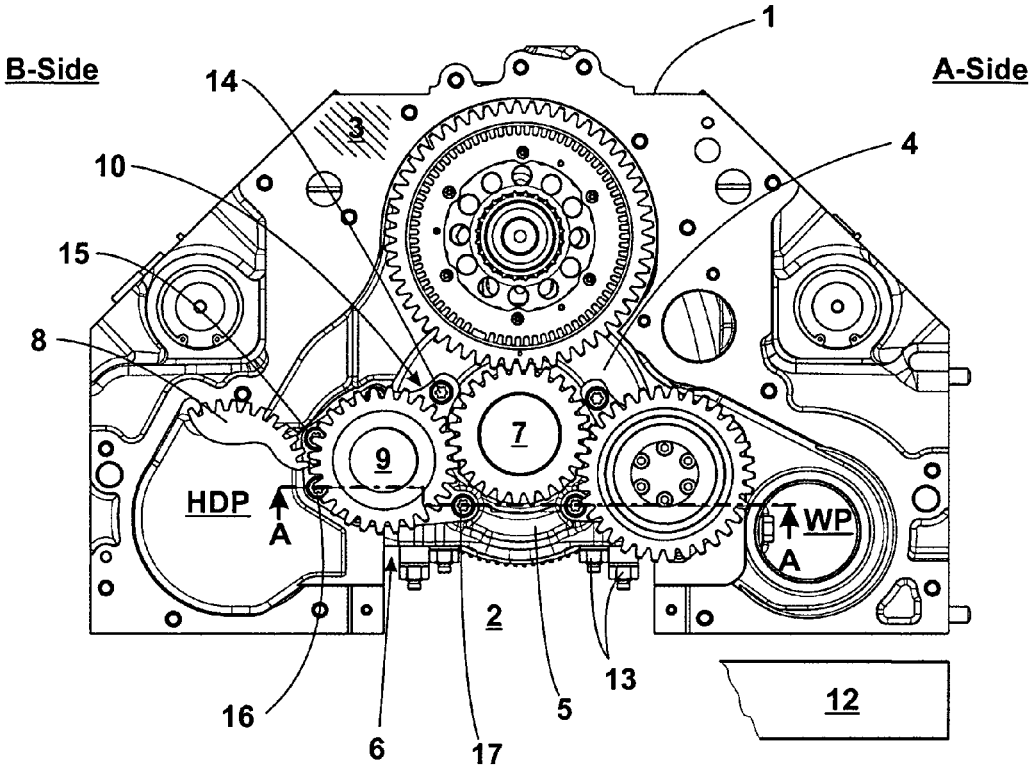
FIG. 1 shows part of the front end side opposite the power output shaft end of an engine.

FIG. 1 shows a crankcase 1 of a V-type internal combustion engine showing the front end 3 of the crankcase opposite the output shaft end of the engine. The further description is done referring also to FIG. 2, which is a cross-sectional view taken along line A-A of FIG. 1. The opposite power output end of the engine is the drive shaft end where the engine torque is transmitted from the crankcase 1 for example to a transmission. The bottom side of the crankcase 1 is closed by a bottom plate 12 which is connected to the crankcase in an oil-tight sealed manner. The bottom plate 12 is only indicated in FIG. 1.

Figure 2:
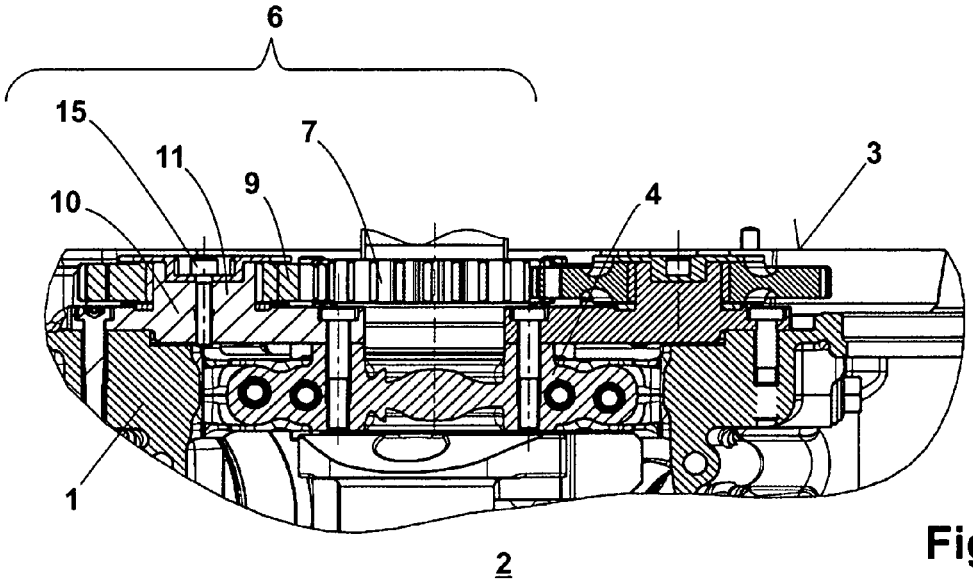
FIG. 2 is a cross-sectional view taken along line A-A of FIG. 1.

An integral part of the crankcase 1 is the crankshaft chamber 2 in which the crankshaft is arranged. The crankshaft is supported in a bearing end cover which is formed by a bearing top part 4 and a bearing bottom part 5, see FIG. 1. The bearing bottom part 5 and the bearing top part 4 are fixed in the crankcase 1 by tension bolts 13. At the front end 3 of the crankcase 1, a gear drive 6 is arranged. By way of the gear drive 6, an auxiliary component is driven such as for example a high-pressure pump HDP for pumping fuel into a rail of common rail fuel injection system. The high-pressure pump HDP is arranged on the B-side of the crankcase 1. The gear drive 6 comprises a first drive gear 7, which is mounted onto the crankshaft, an intermediate gear 9 and a second drive gear 8 which drives the high-pressure pump HDP. The second drive gear 8 is shown only partially in FIG. 1. The intermediate gear 9 is supported via a support pin 11 on a support plate 10, see FIG. 2. The support plate 10 and the support pin 11 are formed integrally. The support plate 10 is fixed in place by four screws. By a first screw, the support plate 10 is mounted onto the upper bearing part 4. By a second screw 15 and a third screw 16, the support plate 10 is screwed onto the crankcase 1. By a fourth screw 17, the support plate 10 is attached to the lower bearing part which is provided with a support surface herefor. By means of the additional screw connecting points for the support plate 10, in particular on the lower bearing part and the upper bearing part 4, the free bending length and, as a result, the bending moments are reduced. The high mounting stability furthermore allows a manufacture of the support plate with a reduced thickness for example of steel which also brings a weight advantage. As shown in FIG. 2, the gear drive 6 is open, that is accessible from the front end 3.

If auxiliary components are arranged on the A-side as well as on the B-side of the crankcase 1 then two geared drives 6 are correspondingly provided. In FIG. 1, the auxiliary component shown on the A-side is for example a water pump WP. The gear drive including the intermediate gear, the support plate and the mounting points on the A-side are identical to the gear drive as described for the B-side.

| Reference Numerals | |
|---|---|
| 1 | Crankcase |
| 2 | Crankshaft chamber |
| 3 | Front side, front end |
| 4 | Upper bearing part |
| 5 | Lower bearing part |
| 6 | Gear drive |
| 7 | First drive gear |
| 8 | Second drive gear |
| 9 | Intermediate gear |
| 10 | Support plate |
| 11 | Support pin |
| 12 | Bottom plate |
| 13 | Tension bolts |
| 14 | First screw |
| 15 | Second screw |

-continued

| Reference Numerals | |
|---|---|
| 16 | Third screw |
| 17 | Fourth screw |

What is claimed is:

1. An internal combustion engine crankcase (1) including a crankshaft chamber (2) with a crankshaft disposed therein, a crankshaft bearing with a bearing end cover arranged at a front end of the crankcase (1) for supporting the crankshaft, the crankshaft bearing end cover including a bearing top part (4) and a bearing bottom part (5), a front end gear drive (6) arranged in front of the crankcase for driving an auxiliary component (HDP) and comprising a first drive gear (7) mounted onto the crankshaft, a second drive gear (8) mounted onto the auxiliary component (HDP) and an intermediate gear (9) in meshing engagement with the first drive gear (7) and the second drive gear (8) and a support plate (10) for supporting the intermediate gear (9), the support plate (10) being screwed to the crankcase (1), the bearing top part (4) and the bearing bottom part (5).

2. The crankcase according to claim 1, wherein the support plate (10) further comprises a support pin (11) on which the intermediate gear (9) is rotatably supported and which is formed as an integral part of the support plate (10).

3. The crankcase according to claim 2, wherein part of the support plate (10) is disposed at an A-side and another part of the support plate (10) is supported on a B-side of the crankcase (1).

* * * * *